United States Patent [19]

Coates

[11] 4,369,039

[45] Jan. 18, 1983

[54] DYEING OF POLYOLEFINS

[75] Inventor: Don M. Coates, Midlothian, Va.

[73] Assignee: E. I. Du Pont de Nemours and Company, Wilmington, Del.

[21] Appl. No.: 338,616

[22] Filed: Jan. 11, 1982

[51] Int. Cl.[3] ..... D06P 1/645; D06P 3/79; D06P 1/653

[52] U.S. Cl. ..... 8/513; 8/580; 8/602; 8/928

[58] Field of Search ..... 8/513, 580, 602

[56] References Cited

U.S. PATENT DOCUMENTS

| | | | |
|---|---|---|---|
| 3,046,076 | 7/1962 | Upshur | 8/55 |
| 3,056,643 | 10/1962 | Kutner | 8/34 |
| 3,069,220 | 12/1962 | Dawson | 8/55 |
| 3,112,981 | 12/1963 | Fuortes et al. | 8/602 |
| 3,128,146 | 4/1964 | Bianco et al. | 8/55 |
| 3,231,530 | 1/1966 | Prahl | 260/23 |
| 3,533,727 | 10/1970 | Grunwald et al. | 8/513 |
| 4,082,887 | 4/1978 | Coates | 428/289 |

FOREIGN PATENT DOCUMENTS

| | | | |
|---|---|---|---|
| 2924661 | 1/1981 | Fed. Rep. of Germany . | |
| 37-15466 | of 1962 | Japan . | |
| 1252747 | 11/1971 | United Kingdom | 8/580 |

*Primary Examiner*—Maria Parrish Tungol

[57] ABSTRACT

A process is provided for dyeing articles of unmodified polyolefin polymer with an aqueous dispersion of a fatty-acid-soluble, solvent dye, a fatty acid and an amine. After application of the dispersion to the article, the amine is volatilized from the applied dispersion. The process is particularly useful in providing novel, dyed, nonwoven fabrics made from polyethylene film fibrils.

5 Claims, No Drawings

DYEING OF POLYOLEFINS

BACKGROUND OF THE INVENTION

1. FIELD OF THE INVENTION

This invention relates to an improved process for dyeing unmodified polyolefin articles with aqueous dispersions of solvent dyes and to novel products produced thereby.

2. DESCRIPTION OF THE PRIOR ART

Unmodified polyolefin polymer is very difficult to dye. The polymer is extremely hydrophobic and lacks active groups which could be receptive to dyes. Dye molecules have great difficulty in penetrating the polymer structure. Nonetheless, numerous types of dyes, dye auxiliaries and methods have been suggested for dyeing unmodified polyolefins. Several known processes, such as those disclosed in U.S. Pat. Nos. 3,046,076; 3,069,220 and 3,128,146, involve dissolving a dye in an organic solvent, forming an aqueous dispersion of the solution, applying the dispersion to a polyolefin article and then drying the article. U.S. Pat. No. 3,056,643 discloses vat dyeing of a polypropylene article with an aqueous dispersion of a dye (e.g., an anthraquinone) in the presence of an amine of the formula $R—NH_2$, wherein R is a hydrocarbon radical having 8 to 22 carbon atoms. Enhancement of the receptivity of a polyolefin article to certain types of dyes by mixing as much as 30% by weight of a fatty acid (e.g., stearic acid) and/or other ingredients into a melt of the polyolefin polymer is disclosed in U.S. Pat. No. 3,231,530 and Japanese Patent Application Publication 15466/62. Though such processes can be useful, improvements still are needed for many commercial applications.

A particularly useful polyolefin article for use as gowns and drapes in hospital operating rooms is made of Tyvek® spunbonded olefin, a nonwoven sheet manufactured by E. I. du Pont de Nemours and Company from film fibrils of unmodified polyethylene polymer. The sheet desirably combines strong water-barrier characteristics with high air permeability and other satisfactory qualities. However, because the sheet can reflect light excessively, it can cause undesirable glare during some surgical procedures. Accordingly, coloration of the sheet has been necessary. U.S. Pat. No. 4,082,887 suggests providing such nonwoven sheets with coatings that contain pigments and various other ingredients designed to avoid detrimentally affecting the desirable water-barrier and air-permeability characteristics. Though such coatings have been useful, they can be expensive and can have less-than-desirable effects on some sheet characteristics.

It is a purpose of this invention to provide an improved process for dyeing articles, such as fabrics, yarns, fibers, films and the like, especially nonwoven film-fibril sheets, made of unmodified polyolefin polymer.

SUMMARY OF THE INVENTION

The present invention provides an improved process for dyeing articles of unmodified polyolefin polymer. The process is of the general type wherein an aqueous dispersion, which is formed with a solvent dye dissolved in an organic liquid, is applied to a polyolefin article and then the article is dried. In the improved process of the present invention, the aqueous dispersion comprises a fatty-acid-soluble dye, a fatty acid having 14 to 20 carbon atoms, and an amine having a pKa (i.e., the negative logarithm of the dissociation constant of the amine) of at least 9 and a normal boiling point in the range of 50° to 150° C., the amine and acid being in a molar ratio of at least 2:1, and after being applied to an article, the amine is volatilized from the dispersion. Preferred fatty acids are saturated, with stearic acid being especially preferred. Preferred amines have a pKa in the range of 9.4 to 12 and a normal boiling point in the range of 60° to 120° C. Triethylamine is especially preferred. The aqueous dispersion preferably comprises by weight 100 parts of water, 0.5 to 20 parts of dye and 3 to 25 parts each of amine and fatty acid.

The present invention also provides a novel product made by the above-described process. The product is a dyed nonwoven fabric made from film fibrils of an unmodified polyolefin polymer, preferably polyethylene polymer. The polymer contains a fatty-acid-soluble dye and a fatty acid that has 14 to 20 carbon atoms, most preferably stearic acid, the acid mounting to 1 to 10 percent by weight of the polymer.

DETAILED DESCRIPTION OF PREFERRED EMBODIMENTS

Many unmodified polyolefin polymers can be dyed by the process of the present invention. Among the polymers are alpha-monoolefins, such as polyethylene, polypropylene, poly(4-methyl pentene-1) and the like, as well as copolymers of such monoolefins. The polymers can be dyed after being shaped into useful articles, such as fibers, filaments, yarns, fabrics, nonwoven sheets, films and the like. The process is particularly useful for dyeing nonwoven sheets made of unmodified polyolefin film-fibrils, such as those prepared by the process described in U.S. Pat. No. 3,169,899.

The sequence of steps in the process of the present invention simply comprises applying an aqueous dye dispersion to a polyolefin article and then drying the article. The aqueous dispersion which is used to dye the article contains, in addition to water, three key ingredients: namely, a fatty-acid-soluble dye, a fatty acid and an amine. Optionally, a defoamer, a surfactant and other ingredients may also be present. Conventional means are employed for application of the dispersion and for drying the article. During the drying, the amine is evaporated from the applied dispersion. The conventional means for applying the dispersion include immersion, padding, spraying, printing and the like. The dispersion may be applied at any convenient temperature, usually below 100° C. and preferably in the range of room temperature to about 50° C. Drying and evaporation of the amine are usually carried out in hot-air ovens or the like, at atmospheric pressure and at elevated temperatures. However, drying temperatures are kept below the melting point of the polyolefin being dyed and below temperatures at which the physical properties of the article may be affected detrimentally.

The types of dyes that are suitable for use in the present invention are generally classified as "solvent dyes", such as those broadly described in "Colour Index", 2nd Edition, The American Association of Textile Chemists and Colorists, Lowell, Mass., page 3563 (1956). However, the dyes must also be "fatty-acid-soluble". It is very simple to determine whether a dye is "fatty-acid-soluble dye". One gram of a "fatty-acid-soluble dye" will dissolve within 5 minutes in a stirred mixture of 3 grams of stearic acid and 3 grams of triethyl amine.

Dyes which do not meet this criterion do not perform satisfactorily in the process of the present invention.

In addition to being soluble in fatty acid, the solvent dyes which can be used satisfactorily in the process of the present invention, after having been dissolved with the fatty acid, must also be capable of forming a usable aqueous dispersion. There is a very simple procedure for determining whether the dissolved dye is water dispersible. A solution of the 1 gram of fatty-acid-soluble dye, 3 grams of stearic acid and 3 grams of triethyl amine, prepared as described above for determining whether a dye is fatty-acid-soluble, is heated to 70° C. and then 50 milliliters of water at 70° C. are added slowly to the solution while stirring is continued for 10 minutes. When dyes which are suitable for use in the present invention are subjected to this test, a precipitate-free, stable, uniform dispersion is formed.

Solvent dyes of the types disclosed in U.S. Pat. Nos. 3,046,076, 3,069,220, 3,128,146, 3,235,322, 3,989,449 and 4,000,985 provide numerous candidates for use in the present process. Fatty-acid-soluble, solvent dyes of the anthraquinone and azo types are useful. The following are fatty-acid-soluble, water-dispersible, solvent dyes that are particularly useful in the present invention: "Automate" dyes Red B (Color Index No. 12140), Red 9BM, Green #6, Green #7, Blue Green, Blue #11, Yellow #8, and Yellow #126; Morton Red 39; Solvent Red 4 (Color Index No. 12170); and "Orasol" dyes Red G (Solvent Red 125), Blue 2GLN and Yellow 2GLN. The "Automate" dyes and the Morton Red are made by Morton-Norwich Products, Inc. of Chicago, Ill., the Solvent Red 4 is a product of E. I. du Pont de Nemours and Company of Wilmington, Delaware; and the "Orasol" dyes are products of Ciba-Geigy Corporation of Ardsley, New York.

The amount of dye which is employed relative to the amount of polyolefin material to be dyed can be varied over a very wide range and will depend to a large extent upon the depth of shade desired. Dyes which amount to as little as 0.5% or less, or as much as 10%, or more, based on the weight of the polyolefin, can be used.

The acids suitable for use in the present invention are fatty acids having 14 to 20 carbon atoms. Fatty acids having fewer than 14 carbon atoms usually do not permit formation of adequate aqueous dispersions with the dye and amine. Fatty acids having more than 20 carbon atoms usually form dispersions that are too highly viscous for use in most dyeing steps. Saturated fatty acids are preferred; unsaturated fatty acids (e.g., linoleic and oleic acids) oxidize readily, causing undesirable odors. From the viewpoint of ease of use in the present process and relatively low cost, stearic acid is the preferred fatty acid.

The amines that find utility in the process of the present invention are characterized by a pKa (i.e., the negative logarithm of the dissociation constant of the amine) of at least 9 and a normal boiling point (i.e., at atmospheric pressure) in the range of 50° to 150° C. Amines that have a pKa significantly below 9 do not permit formation of satisfactory aqueous dispersions with the dyes and fatty acids required in the present process. Although there is no known upper limit on the pKa of the amine, usually, it is preferred to use an amine with a pKa in the range of 9.4 to 12. Amines with normal boiling points in excess of 150° C. generally are insufficiently volatile to permit ready evaporation of the amine during the usual procedures for drying the polyolefin article. Amines having boiling points of less than 50° C. generally do not form adequate aqueous dispersions with the dye and acid. The preferred normal boiling point for the amine is in the range of 60° to 120° C. The following is a list of useful amines:

| Amine | pKa | Boiling Point, °C. |
|---|---|---|
| allyl amine | 9.49 | 53 |
| diethyl amine | 10.93 | 55 |
| diethyl methyl amine | 10.46 | 66 |
| n-butyl amine | 10.60 | 78 |
| pyrrolidine | 11.27 | 87 |
| triethyl amine | 10.87 | 89.3 |
| n-amyl amine | 10.61 | 104 |
| dipropyl amine | 11.00 | 109.4 |
| ethylene diamine | 10.09 | 118 |
| cyclohexyl amine | 10.64 | 134 |

Although allyl amine and ethylene diamine can be used in the process of the invention, the odor of the former and the toxicity of the latter usually lead to choice of another amine from the list. The amine which appears to function most effectively in the process of the present invention, and therefore is most preferred, is triethyl amine.

In preparing the aqueous dispersions required for use in the present invention, the amine and acid are employed in a molar ratio of at least 2:1. The excess of amine aids in the formation of the dispersion. A molar ratio of amine to acid of about 3:1 has been found particularly useful. Higher excesses of amine are technically feasible, but usually are unnecessary and costly. An amine-to-acid molar ratio of less than 2:1 does not permit the formation of an aqueous dispersion that is adequate for use in the process of the present invention.

The amounts of dye, acid and amine which are used to prepare the dispersion can be varied over a rather broad range, as long as the greater-than-2:1-molar-ratio of amine to acid is employed. The following ranges of compositions are useful, though some dispersions outside these ranges also give satisfactory results:

| Ingredient | Parts by Weight |
|---|---|
| Water | 100 |
| Fatty-acid-soluble dye | 0.5–20 |
| Fatty acid | 3–25 |
| Amine | 3–25 |

When an optional surfactant is employed to assist the formation of the aqueous dispersion, it is preferable to use the surfactant in low concentrations. Usually, surfactant concentrations of no more than 2% by total weight of the dispersion, and preferably no more than ½%, are employed. When maximum retention of the hydrophobic and water-barrier qualities of the polyolefin article is desired, it is preferable not to use any optional surfactant in the dispersion.

As pointed out above, during the drying step of the present process, the amine is volatilized from the dispersion that had been applied to the polyolefin article. If the amine is not volatilized, the dye can be washed from the dyed polyolefin article quite easily with soap and water. In contrast, if the amine is volatilized as prescribed in the process of the present invention, the dyed polyolefin article is fast to laundering and washing.

In using the process of the invention, the conditions of dyeing and drying are arranged so that the resulting dyed polyolefin article usually contains between about 1 and about 10% by weight of the fatty acid.

The examples below illustrate the invention. Unless otherwise stated, all percentages are by weight of the total mixture. The several characteristics of the dyed polyolefin products mentioned in the examples are evaluated by the following methods:

Crocking performance is measured with a Model CM-1 Crockmeter, manufactured by Atlas Electric Devices of Chicago, Ill., with a linen rubbing surface. Each test sample is given 20 Crockmeter strokes and then the linen surface is examined for color transfer.

Light-fastness is measured by means of exposure of a sample to a Xenon-arc lamp in a Fade-O-Meter, manufactured by Atlas Electric Devices of Chicago, Ill.

Water-barrier characteristics are measured by the "hydrostatic-head" test, as described in ASTM D-583, paragraph 53A, Method II.

The amount of stearic acid contained in the dyed product is measured by infra-red spectrographic analysis.

EXAMPLE I

This example describes the dyeing of a nonwoven sheet of polyethylene film fibrils by a gravure-printing technique.

The following ingredients were mixed in a kettle at room temperature: 1350 grams of stearic acid; 1500 grams of dye solution consisting of 30%, "Automate" Green #7, 30% "Automate" Blue #11 and 40% triethyl amine; 900 grams of triethyl amine; and 75 grams of "Zonyl" FSN-100 (a nonionic fluorosurfactant product of E. I. du Pont de Nemours and Company). The ingredients were heated to 45° C. and stirred for a few minutes until a solution of all the ingredients was formed. The temperature was then raised to about 55°-60° C., stirring was continued and 13 liters of water were added. During the water addition the temperature was maintained above 50° C. at all times. An aqueous dispersion formed and was then heated further to 70° C. and stirred for 15 minutes. To reduce foaming of the dispersion, 4 grams of "Foamkill" 830-HP (a 30% aqueous dispersion of a silicon-based defoamer, sold by Crucible Chemical Co. of Greenville, South Carolina) were added to the dispersion. The total dispersion was then cooled to about room temperature.

The cooled dispersion was then applied to a 42.5-gram-per-square-meter sheet of Tyvek® spunbonded olefin by means of a 175-mesh-pattern gravure printing-press roll. Tyvek® is a nonwoven sheet made of polyethylene film fibrils by E. I. du Pont de Nemours and Company. The wet sheet was passed directly from the gravure roll to a dryer where the sheet was dried by air at 90° C. During the drying, the triethyl amine was evaporated from the dispersion that had been applied to the sheet.

The thusly dried nonwoven fabric, was uniformly dyed on one side with a pleasing medium blue-green shade and contained approximately 3% of stearic acid. The dyed sheet exhibited excellent crock-resistance wet and dry (20 cycles by the crock-meter test) and very good light fastness (only a slight deterioration was noted after 40 hours of "Fade-O-Meter" testing). Furthermore, the air permeability, water-barrier, hand, and other characteristics of the sheet were not detrimentally changed by the dyeing process.

EXAMPLE II

Example I was repeated, except that the amounts of acid, amine and dye solution were doubled. The results were similar to those obtained in Example I, except that the nonwoven sheet was dyed a deeper shade.

EXAMPLE III

This example describes the dyeing of a nonwoven fabric of polypropylene fiber.

A dye bath was prepared by mixing the following ingredients in a vessel at room temperature: 9 grams of stearic acid, 4 grams of "Automate" Red 9BM; 10 grams of triethyl amine; and 0.5 gram of "Zonyl" FSN-100. The mixture was heated to about 45° C. and stirred until all ingredients dissolved. The temperature was then raised to 55° C. and 100 milliliters of water were added slowly, while maintaining the temperature of the mixture was maintained above 50° C. An aqueous dispersion was formed. After the water addition, the dispersion was heated further to 70° C. and stirred for 10 minutes. The dispersion was then allowed to cool to 40° C.

Strips of Typar® spunbonded polypropylene nonwoven fabric (manufactured by E. I. du Pont de Nemours and Company) were submerged in the thusly prepared dye bath for 5 minutes at 40° C. The fabric strips were then removed from the bath, excess liquid was drained from the fabric, and the fabric was dried in a forced-air oven at 130° C. for 10 minutes. During the drying the amine was evaporated from the fabric. The fabric was then scoured with acetone. The dyed fabric had a medium to dark shade of red and was very crock-fast, wet and dry.

EXAMPLE IV

This example describes the dyeing of a yarn of poly(4-methyl pentene-1) fibers.

A dye bath was prepared as in Example III, except that the temperature of the bath was maintained at 70° C. A three-yard length (2¾ meters) of 2.4 denier-per-filament (0.27-tex), multifilament yarn was submerged in the bath for 5 minutes, then removed from the bath and dried for 10 minutes in a forced-air oven operating at 130° C. After cooling, the yarn was rinsed with acetone. The resultant yarn was a deep red shade and exhibited excellent wet and dry crockfastness.

EXAMPLE V

This example describes the dyeing of a tubular knitted fabric of 18 dpf (2.0 tex) filaments of poly(4-methyl pentene-1).

A dye bath was prepared by mixing the following ingredients in a vessel at room temperature: 9 grams of stearic acid; 10 grams of dye solution consisting of 60% "Automate" Blue #11 and 40% triethyl amine; 5 grams of triethyl amine; and 0.5 gram of "Zonyl" FSN-100.

The mixture was heated to about 45° C. and stirred until all of the ingredients were dissolved. The solution was then heated to 55° C. and 100 milliliters of water were slowly added, while the bath temperature was maintained above 50° C. A dispersion formed. The dispersion was stirred for 10 minutes at 70° C. A 10-cm by 10-cm sample of the knitted fabric was submerged in the 70° C. bath for 10 minutes. The wet fabric was removed, squeezed, and dried for 10 minutes in a forced-air oven operating at 130° C. The fabric was then scoured with a detergent solution of "Alconox" (a product of Alconox, Inc. of New York, New York) and then thoroughly rinsed with water. The resulting fabric was dark blue and exhibited good wet and dry crock-fastness.

EXAMPLE VI

This example describes the dyeing of a polyethylene film.

A dye bath was prepared by mixing the following ingredients in a vessel at room temperature: 10 grams of stearic acid; 6.7 grams of "Automate" Green #7 dye solution and 1.6 grams of "Automate" Blue #11 dye solution, each dye solution consisting of 60% dye and 40% triethyl amine; 10 grams of triethyl amine; and 1 gram of "Zonyl" FSN-100. The mixture was heated to about 45° C. and stirred until all the ingredients had dissolved. An aqueous dispersion of the solution was then formed by raising the temperature to 55° C. and adding 100 milliliters of water, while continuing stirring and maintaining the temperature above 50° C. during the water addition. The dispersion was then heated further to 70° C. and stirred for 10 minutes.

A 0.075-millimeter-thick polyethylene film, which had been rinsed with acetone and dried, was dyed with the previously prepared dispersion. A "Meyer" rod (i.e., a rod wrapped with a wire) was used for application and drawing of the dispersion across the surface of the film. The wet film was then dried for 3 minutes in a forced-air oven operating at 60° C.

The resulting film was blue-green in color and had a high resistance to crocking. Color could not be removed even by abrasion of the film surface with sandpaper. Microtome specimens of the dyed film, when examined under a microscope, showed complete penetration of dye throughout the film.

I claim:

1. An improved process for dyeing articles of unmodified polyolefin polymer, of the type wherein an aqueous dispersion, which is formed with a solvent dye dissolved in an organic liquid, is applied to the article and then the article is dried, wherein the improvement comprises the aqueous dispersion containing a fatty-acid-soluble dye, a fatty acid having 14 to 20 carbon atoms, and an amine having a pKa of at least 9 and a normal boiling point in the range of 50° to 150° C. the amine and acid being in a molar ratio of at least 2:1, and after application of the dispersion to the article, volatilizing the amine therefrom.

2. The process of claim 1, wherein the acid is a saturated fatty acid, the amine has a pKa in the range of 9.4 to 12 and a boiling point in the range of 60° to 120° C. and the dispersion comprises by weight 100 parts of water, 0.5 to 20 parts of dye, 3 to 25 parts of amine and 3 to 25 parts of fatty acid.

3. The process of claim 1 or 2 wherein the amine is triethyl amine and the acid is stearic acid.

4. A dyed nonwoven fabric made from film fibrils of unmodified polyolefin polymer wherein the polymer contains a fatty-acid-soluble dye and a fatty acid that has 14 to 20 carbon atoms and amounts to 1 to 10 percent by weight of the polymer.

5. The nonwoven fabric of claim 4 wherein the film fibrils are of polyethylene and the acid is stearic acid.

* * * * *